United States Patent [19]

Eigenmann

[11] Patent Number: 4,708,518

[45] Date of Patent: Nov. 24, 1987

[54] METHOD OF ADHERING A PREFABRICATED MARKING STRIP TO A ROADWAY SURFACE WITHOUT HAVING TO TREAT THE ROADWAY SURFACE AND SELF-ADHESIVE SEALING STRIP ITSELF

[76] Inventor: Ludwig Eigenmann, Via Dufour 3, CH 6900 Lugano, Switzerland

[21] Appl. No.: 888,175

[22] Filed: Jul. 22, 1986

[30] Foreign Application Priority Data

Jul. 23, 1985 [CH] Switzerland ..... 03198/85
Mar. 13, 1986 [CH] Switzerland ..... 01019/86

[51] Int. Cl.[4] ..... E01F 9/08

[52] U.S. Cl. ..... 404/79; 404/94; 404/95

[58] Field of Search ..... 404/9, 12, 14, 72, 79, 404/94, 95

[56] References Cited

U.S. PATENT DOCUMENTS

| | | | |
|---|---|---|---|
| Re. 31,669 | 9/1984 | Eigenmann | 404/12 X |
| 2,076,172 | 4/1937 | Bowden | 404/94 |
| 3,844,669 | 10/1974 | Eigenmann | 404/94 |
| 3,886,011 | 5/1975 | Eigenmann | 404/94 |
| 3,902,666 | 9/1975 | Ito et al. | 404/94 X |
| 4,012,247 | 3/1977 | Eigenmann | 404/72 |
| 4,082,587 | 4/1978 | Eigenmann | 404/79 |
| 4,102,718 | 7/1978 | Eigenmann | 404/94 X |
| 4,236,950 | 12/1980 | Eigenmann | 404/72 |
| 4,376,007 | 3/1983 | Eigenmann | 404/12 X |
| 4,565,467 | 1/1986 | Eigenmann | 404/72 |

FOREIGN PATENT DOCUMENTS

| | | | |
|---|---|---|---|
| 276538 | 8/1927 | United Kingdom | 404/72 |
| 920539 | 3/1963 | United Kingdom | 404/94 |

*Primary Examiner*—James A. Leppink
*Assistant Examiner*—Matthew Smith
*Attorney, Agent, or Firm*—David H. Semmes; Warren E. Olsen

[57] ABSTRACT

This invention concerns a process for making a roadway marking strip adhere to a roadway surface without the need for any preliminary preparation, using a flame that simultaneously contacts the self-adhesive primer coating of the roadway strip and the roadway surface itself. This invention also concerns a process for covering the adhesive primer layer on the roadway strip with a thin sealing layer, and thus-formed roadway strip.

2 Claims, 4 Drawing Figures

METHOD OF ADHERING A PREFABRICATED MARKING STRIP TO A ROADWAY SURFACE WITHOUT HAVING TO TREAT THE ROADWAY SURFACE AND SELF-ADHESIVE SEALING STRIP ITSELF

DESCRIPTION

As is well known, the use of prefabricated roadway marking strips is important for traffic safety, and that a primer layer is usually applied to the roadway surface before the marking strips are applied.

This primer layer is usually sprayed onto the roadway surface without any particular previous preparation of the roadway surface, the primer being ready to receive the marking strip as soon as the solvent in the primer evaporates. The applicant of this patent holds numerous patents concerning horizontal roadway marking strips, many of which deal with methods for adhering the strips to the roadway surface and the relative equipment. Among these are U.S. Pat. Nos. 3,844,669, 3,902,939 and 4,102,718. There is an increasing need today for technologies that can guarantee high marking-strip efficiency and long service life for a wide range of roadway surface, both as regards type and location, as well as shorter installment times. Notwithstanding the progress already made in this direction—helped considerably by the applicant's aforesaid patents—the solution to the problem is not yet definitive.

The intention of this invention is to provide an adequate answer to the aforesaid requirements, constituting a very important innovation as regards a method for depositing and adhering a roadway marking strip to a roadway surface. The main purpose of the primer—a considerable amount of which is absorbed by the roadway surface—is to provide a waterproof barrier to the action of the water lying beneath the roadway surface. It also has to be compatible with the lower side of the marking strip, as well as be able to resist a roadway surface temperature that can become as high as 70 deg. C. Also, since most of the primer is absorbed by the roadway surface, its raw materials must have a low cost. In addition, because of its being water repellent, its viscosity must be low enough to allow it to be quickly and easily absorbed into the pores of the roadway surface.

This latter characteristic is usually obtained with the addition of solvents, but there is the drawback of the installation taking more time. Some operators have attempted to overcome this drawback by doing away with the use of the primer, but poor results have often been obtained.

With this invention, a detailed consideration is made of the dynamics of the strip-adherence process.

Water generally tends to collect in the pores and channels found in the roadway surface. In terms of service life the effects of surface tension, capillary action and the more easily understood phenomena connected with the freezing of this water, have compounded the problem because of the resulting pressure built-up under the marking strip. This humidity does not facilitate the absorption of the primer by the roadway surface. If the primer contains volatile water-absorbent components, the evaporation of these components will cause vacant spaces that will reduce the overall water-barrier capability of the primer.

If the marking strip is laid without the primer, a zone containing channel and pores will be formed between the adhesive primer and the roadway surface that can very easily permit the infiltration and action of weather.

According to this invention, the problem can only be solved if optimum adherence conditions are simultaneously created both for the adhesive prmer and the roadway surface. The adhesive temperature must be as high as possible to assure maximum fluidity, and the roadway surface must be in the completely dry state, so as to be in the absorbent phase. When these simultaneous conditions are obtained, the surfaces are made to contact each other, the molten primer is drawn in by the roadway surface, closing off all the pores and channels, and maximum duration of the adherence is provided.

This invention therefore provides for the use of a marking strip which has an abundant film of adhesive primer compound attached to its lower side that, when heated to its melting point, acts both as a sealer and a primer at the same time. The laying of the strip is done with the use of a flat-shaped flame which heats both the adhesive film and roadway surface at the same time. As a general example, about one-third of the flame heats the film and two-thirds heats the roadway surface.

The flat shape of the flame is due both to the shape of the flame-generator nozzle (12, FIG. 1) and to the rather high pressure with which it exits from the generator, which makes it flatten out even further when it strikes the strip and roadway surface.

In an alternate version of this invention, the sealing is increased by coating the primer with a thin film of sealing compound. It very often happens, in fact, in particular geologic areas, especially after long sustained periods of wet weather, that a strong hydrostatic pressure builds up under the roadway surface, and permits humidity to seep through the fine pores in the roadway surface. This humidity then forms a thin cushion between the roadway surface and the adhesive, which, under adverse conditions, can cause detachment of the strip.

It has been found advantageous to seal the roadway surface pores by coatig the primer with a thin film of sealant whose flow properties are such as to allow it to adequately plug all the fine pores found in the roadway surface. As a rule, the thickness of the sealant should be about one-fifth that of the adhesive, so as to avoid strip creep during the warm seasons. Part of the sealant is absorbed by the roadway surface and part is incorporated in the adhesive. As an alternative, therefore, we have an adhesive sealing, marking strip.

Figure 1:
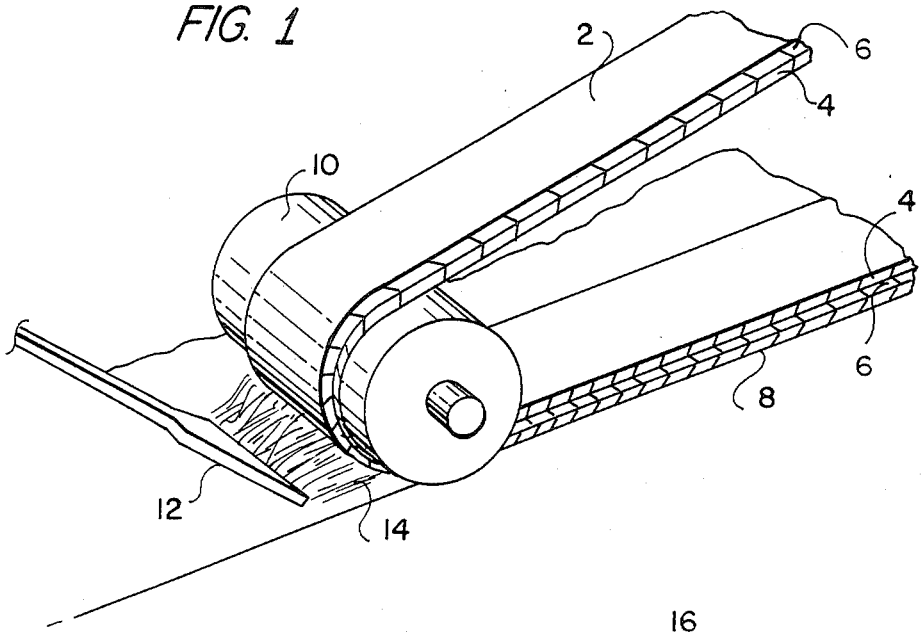
FIG. 1 shows a marking strip being laid using the process described in this invention.

FIG. 1 precisely shows the strip (2) as schematically consisting of two layers (4) and (6); the layer (4) having the road-marking function and layer (6) the adhesive function. The roadway cross-section is shown by (8). The roller, shown schematically by (10), is part of the equipment used for laying the strip, which does not need to be shown in detail.

Figure 2:
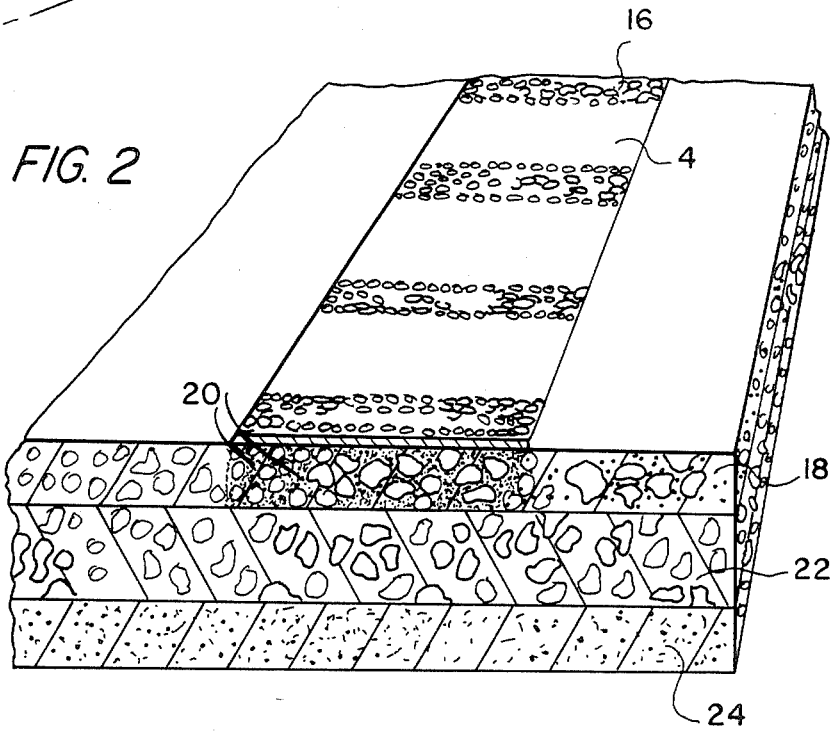
FIG. 2 shows a sectional view of the roadway surface with the marking strip applied and made adherent to the roadway surface.

The flat flame (14) is produced by the generator shown schematically by (12). The flat flame strikes layer (6) of the marking strip and the roadway surface (8) at the same time. FIG. 2 ref. (4)—which could be provided with optical elements (16)—represents the roadway marking portion of the marking strip. The molten self-adhesive material is shown as having displaced the humidity contained in the channels—shown in black in zone (20) of the roadbed cross-section with its layers (18), (22) and (24)—and sealing them off.

Figure 3:
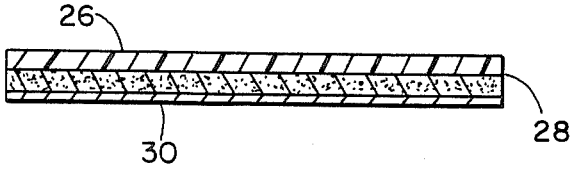
FIG. 3 shows a sectional view of the alternative configuration with the layer of sealant added to the marking strip.

In FIG. 3, the polyurethane layer (26), the adhesive layer (28) and the very thin layer of sealant (30) are shown.

Figure 4:
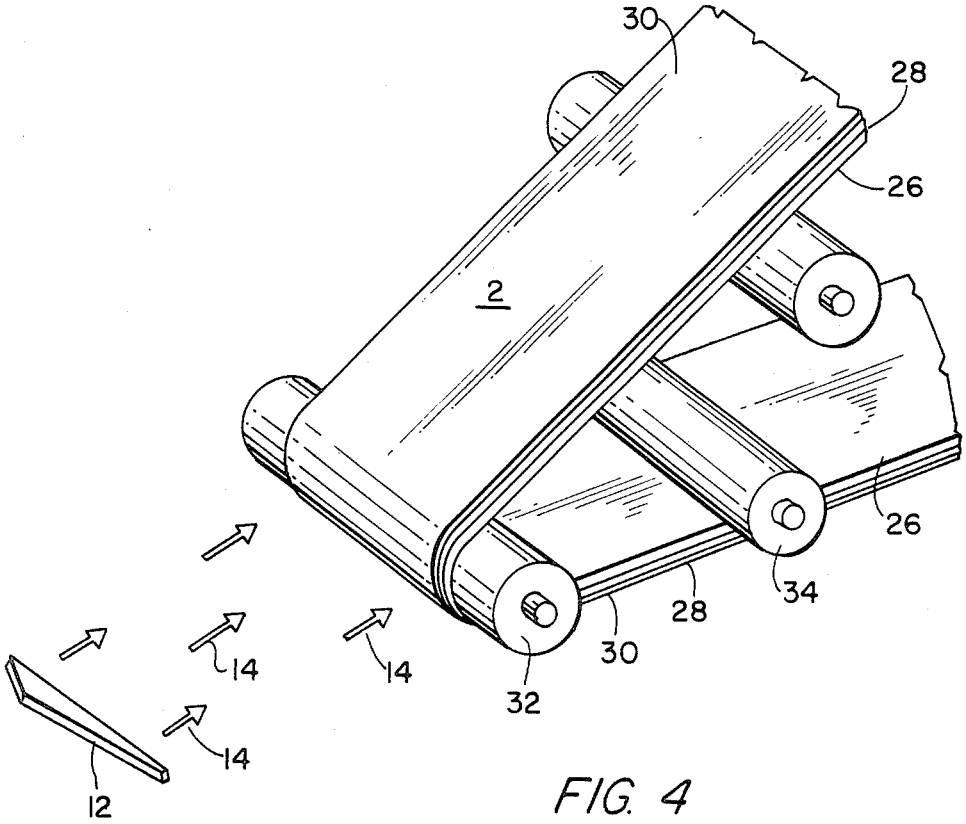
FIG. 4 shows a strip-laying method which is analogous to the one shown in FIG. 1 and which is particularly adapted for the marking strip having the sealant.

In FIG. 4, (2) is the marking strip being laid, (12) is the flame generator, (14) is the flame and (32) is the laying roller. This laying roller is best completed by an auxiliary roller (34)—which is smaller and rotates faster—whose purpose is to provide further anchoring pressure on the hot sealant pressing against the roadway surface. Such additional anchoring pressure is effective even when the roadway surface is relatively smooth.

As an example, one sealing-compound formulation that has given good results is the following:

VISTANEX LMMH: (Esso) 300 parts
POLISAR BUTILE 302 (Polisar): 100 parts
ESCOREX 1310 (Esso): 100 parts
PENTALIN H (Hercules): 50 parts Under optimum conditions, a marking strip laid in accordance with the process described in this invention will not be subject to any creep phenomena at warm-weather temperatures. In any case, best results are obtained—especially as regards the sealing, adhesive, marking strip—when the length of the flame is correct. The flame should strike both the strip and the roadway surface contemporaneously over a length proportional to the maximum strip-laying speed.

In addition to being economical, sludges obtained from the treatment of waste lubricating oils with either acid or solvents have been found to be advantageous for use in the making of adhesive primers.

For an optimum type of adhesive primer for use in the process described in this invention, it was found, for example, that mixing the aforementioned sludge with appropriate proportions of an elasticizer, such as, for example, copolymer terpolymer ethylene propylene—say, 7%—and a hardener such as, for example, isotaxic polypropylene—say, 7%—gives an adhesive-primer compound having very good properties. The low cost of this adhesive primer permits it to be used generously in layer thicknesses, for example, of from 1 to 2 millimeters. Furthermore, it is easily flame-softened and adheres strongly to the roadway-surface irregularities. This fact advantageously resolves the more difficult problems regarding conformance to the roadway surface, as well as the problems regarding the cost of the intermediate layer, which replaces the calendered rubber layer. A nonwoven fabric can be used for this purpose, which does not need to have exceptional elongation properties, but will have, once appropriately impregnated, good mechanical properties. When this adhesive primer is in the form of a thick layer and is flame-softened, the strip-laying problems are greatly simplified.

A nonwoven fabric, impregnated with a low-cost elastomer and weighing, for example, 350 g/m$^2$, could be advantageously used in place of the calendered rubber layer underneath, say, a polyurethanic marking film weighing 300 g/m$^2$, the nonwoven fabric then being coupled with a thick, sludge-derived adhesive primer weighing, say, 1200 g/m$^2$. Conformity to the roadway surface, when using the flame, becomes exceptional.

I claim:

1. Process for attaching marking strip of the type provided on its underside with an adhesive primer to a roadway surface comprising:

(a) applying a low viscosity adhesive primer of the type derived from lubricating oil waste to the underside of the marking strip;

(b) rotatably laying the strip onto the roadway surface; and (c) positioning a single elongated flat flame nozzle adjacent the roadway and marking strip, so as to simultaneously apply a pressurized flat shape flame onto the roadway surface and across the underside of the marking strip, while orienting the flat shape flame so as to dry and render absorbent the roadway surface prior to heating said adhesive primer to melting point, such that the adhesive primer is drawn into the roadway surface as a seal during said laying of marking strip.

2. Process for attaching marking strip of the type provided on its underside with an adhesive primer to a roadway surface as in claim 1, wherein said orienting of flat shape flame includes about two-thirds of said flame heating the roadway surface and one-third of said flame heating the marking strip.

* * * * *